United States Patent [19]

Crosby

[11] 4,092,164

[45] May 30, 1978

[54] REFLECTANCE PROBE

[75] Inventor: Robert J. Crosby, Cleveland, Ohio

[73] Assignee: Horizons Incorporated a division of Horizons Research Incorporated, Cleveland, Ohio

[21] Appl. No.: 581,084

[22] Filed: May 27, 1975

[51] Int. Cl.[2] ..... G03C 5/04; G03C 5/24

[52] U.S. Cl. ..... 96/27 R; 96/48 R; 96/90 R; 250/571

[58] Field of Search ..... 96/48 R, 27 R, 27 E, 96/90 R; 250/571, 316

[56] References Cited

U.S. PATENT DOCUMENTS

| | | | |
|---|---|---|---|
| 3,042,517 | 7/1962 | Wainer | 96/90 R |
| 3,510,300 | 5/1970 | Fotland et al. | 96/90 R |
| 3,573,046 | 3/1971 | Fotland et al. | 96/48 R |
| 3,618,504 | 11/1971 | Fotland | 96/45.2 |
| 3,620,748 | 11/1971 | Fichter | 96/90 R |

*Primary Examiner*—Won H. Louie, Jr.
*Attorney, Agent, or Firm*—Lawrence I. Field

[57] ABSTRACT

A method and apparatus for monitoring the buildup of fog in a non-silver free radical film while a latent image in said film is being optically developed, wherein the buildup of fog is sensed by radiation directed at a non-image area of said film and reflected from said area to a sensing device. The reflected radiation is altered as the buildup of fog takes place.

2 Claims, 2 Drawing Figures

REFLECTANCE PROBE

Figure 1:
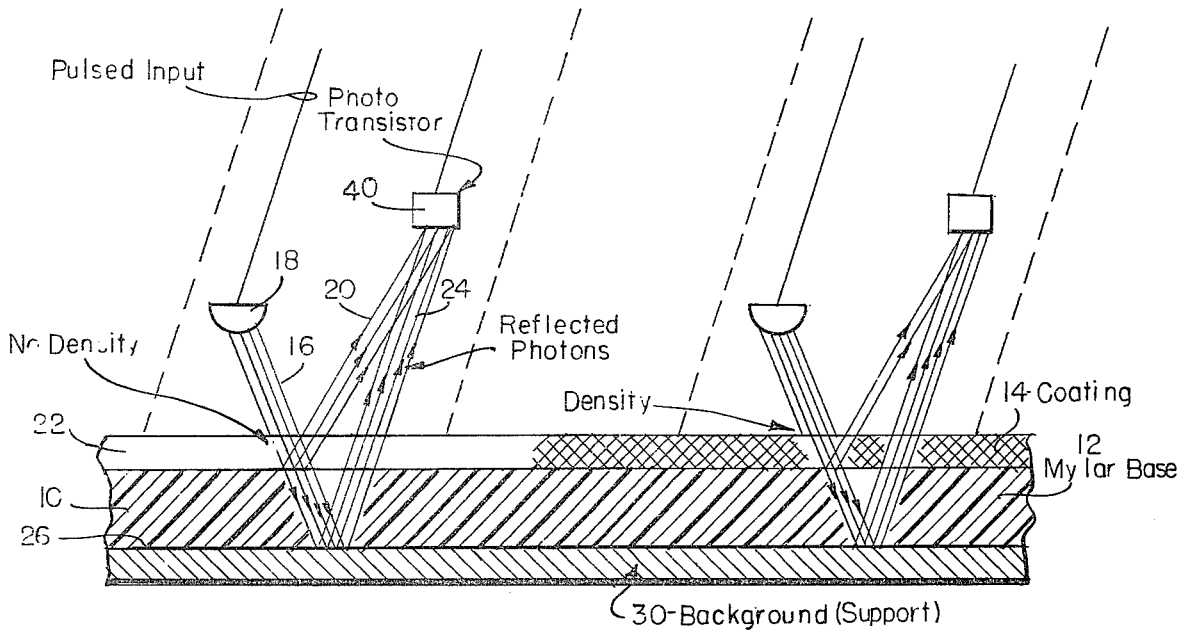

This invention relates to improvements in the dry development of non-silver photosensitive films, e.g. as described in U.S. Pat. Nos. 3,510,300 issued May 5, 1970; 3,573,046 issued Mar. 30, 1971; 3,618,504 issued Nov. 9, 1971 and 3,732,098 and 3,731,612 both issued May 8, 1973 and in an article entitled "Red Light Development of Latent Images" published on pages 49 and 50 of Symposium III "Unconventional Photographic Systems" by the Society of Photographic Scientists and Engineers, Washington, D.C. "Advance Printing of Invited Papers and Summaries".

As described therein, photosensitive films which have been exposed to a pattern of suitable radiation so as to produce a latent image in the film can be developed by blanket exposure to radiation of other wavelengths than the radiation which produced the latent image.

The satisfactory practice of the procedures described in the above noted patents has been found to be complicated by the sensitivity of the film to the developing radiation, causing the film to fog in areas other than those bearing the latent image, whereby contrast between the developed image and the background is diminished by the presence of such fog.

The individual who is developing the visible image is usually unaware of the previous history of the film and hence does not know the duration or extent of the latent image producing exposure, and may also be ignorant as to the film composition, age, storage, history and other variables characteristic of the specific film being developed. Since these may all affect the manner in which the film responds to the blanket exposure made for purposes of developing a visible image and fixing the film, it would be helpful to him to have some indication as to the development of fog in the unexposed (non-image) areas of the film, as a consequence of the blanket exposure.

The present invention is directed to a method and apparatus for providing to the individual performing the development of the film, information concerning the generation of fog in the non-image areas, during the development exposure so that the development exposure can be halted before the background or fog becomes excessive.

The film utilized in the practice of the invention is conventionally slightly wider than the area which is exposed during the picture taking step. The present invention is predicated of the inspection of these unexposed, non-image borders of the film strip by suitable means which read the "fogging" of the film incidental to the optical development of the film and which means may be caused to automatically terminate the development step when any previously selected value of base plus fog is reached in the non-image borders of the film strip.

In one mode of practicing this invention, the film to be monitored is positioned within an apparatus such as is described in above noted U.S. Pat. No. 3,573,046, and while it is being optically developed, a scan is made along the "unexposed" margins of the film, by traversing said margin with radiation from a light emitting diode, acting as a probe, from which the light level is so low that the film is not fogged to any appreciable extent. The input radiation strikes the film at an angle and part of the probe radiation is reflected from the surface between the film and the film base and another part of the radiation is reflected from the interface between the film base and the surface on which it is supported. An output signal is monitored by a suitable sensor. Changes in the output signal are amplified and indicated on any suitable meter, e.g., a microammeter, which can be calibrated to indicate when the base plus fog has reached a significant level, selected to avoid a loss of contrast.

The invention is also applicable to film being developed while moving through an apparatus as described in U.S. Pat. No. 3,618,504, and is intended to be an improvement over the closed loop control system described in FIG. 6 of that patent.

In the present invention instead of exposing the edge strip of the film to a preselected density level, only the unexposed (non-image) regions are monitored for density increases, indicative of fog or background in the film.

The manner in which the fog level builds up is a function of the properties characteristic of any specific film and depends on the film composition and its history. The fog level is thus directly related to the actual photographic speed of the film, and can be used as the control by which long lengths of film can be processed regardless of variations in the photographic speed along the length of the film.

In the present invention the probe assumes that for a particular film sample the surface reflection and interlayer reflections are a constant the interlayer reflection is the layer where the film is coated onto the Mylar backing. The interlayer reflection is the one of interest. The initial reflections in the sample are zeroed out by a zeroing circuits. The quantity which changes as the film fog builds up is the interlayer reflection. The more dense the film fog level, more photons are absorbed into the sensitive layer (film) and fewer photons are reflected from the interlayer back to the photo transistor. This information is processed and displayed as film fog level.

In brief, an apparatus used in the practice of this invention in a stationary mode (film not moving) for one specific film composition consisted of a light emitting diode emitting a 665 nm and a photo transistor receptor. The film being monitored for fog buildup was introduced into the light path and the changes in output signal were amplified and indicated on a microammeter. This can be used in the apparatus of 3,573,046.

With a film moving continuously through an apparatus such as that shown in U.S. Pat. No. 3,618,504, a uniform light emission across the apparatus is obtained from a suitable array of light emitting diodes.

Since relatively little development occurs during the first part of the lighted path, it has not been found necessary to monitor the fog level in this part of the apparatus. Actually at relatively slow rates of film advance, the fog appears to be formed in the last 25% of the development path through the apparatus.

When a sensor along the film path detects a premature fog buildup, the lamps used for development can be dimmed or even extinguished for the remainder of the film travel through the apparatus, until the sensor detects the cessation of premature fogging.

The films to which the present invention is applicable are compositions such as those described in patents issued to Eugene Wainer and others of his co-workers at Horizons Research Incorporated including the following:

3,042,517 issued July 9, 1962

3,620,748 issued Sept. 21, 1971
3,510,300 issued May 5, 1970
and others of a similar nature.

The illumination selected for the development exposure depends to some extent on the film composition, e.g., as described in the above noted Paper published by the Society of Photographic Scientists and Engineers. Similarly, the illumination selected for the probe of this invention should have such a low level that the film is not affected (fogged) to any appreciable extent by the probe.

By the present invention it becomes possible to use light levels so low that the film is not affected. It is also possible to automatically compensate for background light levels.

The small probe can be portable and can be used to compare the absorption of a clear base material with that of an image containing area of the film.

As the fog builds up in the background (non-image) areas during red light development of the film, the number of photons absorbed by the film increases and the number of reflected photons decreases, whereby the output signal received by the photo transistor decreases. The reduction in photons is interpreted as a fog level by suitable circuitry.

Figure 2:
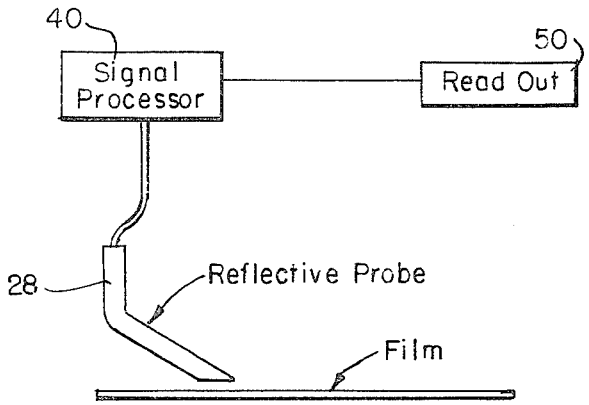

The invention will be further understood by reference to the drawings accompanying this application in which:

FIG. 1 is a schematic showing the application of the probe of a film, one area of which is unfogged and a second area of which has begun to develop a fog in the background; and FIG. 2 is a block diagram showing the reflective probe of FIG. 1 coupled to means for reading a signal produced by the film being developed.

FIG. 1 shows means to scan a film 10 consisting of a clear mylar base 12 to which there is attached a light sensitive coating 14 having a composition of the type previously noted. The film is scanned along at least one "unexposed" margin of the film, by traversing said margin with radiation 16 from a light emitting diode 18, acting as a probe 28, from which the light level is so low that the film is not fogged to any appreciable extent. The input radiation 16 strikes the film 14 at an angle and part 20 of the probe radiation 16 is reflected from the interface 22 between the film coating 14 and the film base 12 and another part 24 of the input radiation 16 is reflected from the interface 26 between the film base 12 and the surface 30 on which it is supported. An output signal produced by the combination of reflected portions 20 and 24 is monitored by a suitable sensor 40. Changes in the output signal are amplified and indicated on any suitable meter 50, e.g., a microammeter, which can be calibrated to indicate when the base plus fog has reached a significant level, selected to avoid loss of contrast.

The invention is also applicable to film in which there is present one or more layers above or below the photosensitive layer, e.g. layers present as a protective overcoat or as a subbing layer or for other purposes, and the signal received will also include reflections from the interfaces of such additional layers, but will not alter the operation of the probe.

Having now described the invention, it is not intended that it be limited except as required by the appended claims.

I claim:

1. In a process for monitoring the extent to which a background of fog develops in a non-silver free radical film in which an image is developed by blanket exposure of said film to radiant energy of a suitable wavelength after said film has been subjected to a latent image forming exposure by exposure to a pattern of radiation wherein said film comprises a clear base layer and a photosensitive coating on said base layer, the improvement which comprises:

while said image is being developed by said blanket exposure, traversing a non-image area of said film coating with radiation from a light emitting diode, acting as a probe and insufficient to produce any appreciable fogging of said film coating, said radiation being projected to strike said film coating at an angle so that one portion of the probe radiation is reflected from the interface between the film coating and the film base layer and a second portion is reflected from the interface between the film base layer and the surface on which the film base layer is supported;

providing radiation sensing means to receive the combination of both of said reflected radiations and to produce a signal indicative of the extent of fogging in said film coating, as a result of said exposure;

and causing said blanket exposure for development to be discontinued when the base plus fog reaches the desired level.

2. The process of claim 1 wherein the film contains at least one additional layer in addition to said base layer and said photosensitive coating and the combination of reflected radiations includes radiation reflected from at least one interface between said additional layer and the remainder of said film.

* * * * *